United States Patent [19]

Watterback

[11] 3,977,351

[45] Aug. 31, 1976

[54] ANCHOR

[76] Inventor: Paul Gunnar Wätterbäck, Hornsgatan 39A, 116 49 Stockholm, Sweden

[22] Filed: July 2, 1975

[21] Appl. No.: 592,692

[30] Foreign Application Priority Data

July 5, 1974 Sweden ..... 7408903

[52] U.S. Cl. ..... 114/208 R

[51] Int. Cl.[2] ..... B63B 21/24

[58] Field of Search..... 114/208 R, 207; 52/162, 52/163, 164

[56] References Cited

UNITED STATES PATENTS

| | | | |
|---|---|---|---|
| 915,784 | 3/1909 | Miller | 52/162 |
| 2,267,657 | 12/1941 | Korvin-Kroukovsky | 114/208 R |
| 2,722,191 | 11/1955 | Johnson | 114/208 R |
| 3,022,761 | 2/1962 | Beixedon | 114/208 R |
| 3,022,762 | 2/1962 | Hillcourt | 114/208 R |
| 3,557,739 | 1/1971 | Kaercher | 114/208 R |
| 3,618,554 | 11/1971 | Patten | 114/208 R |
| 3,822,664 | 7/1974 | Hedman | 114/208 R |

*Primary Examiner*—George E. A. Halvosa
*Assistant Examiner*—Charles E. Frankfort
*Attorney, Agent, or Firm*—Sughrue, Rothwell, Mion, Zinn and Macpeak

[57] ABSTRACT

An anchor comprises a frame, and two pointed flukes pivotable in relation to the frame to both sides between a storage position substantially in the plane of the frame and an anchoring position. The pivots extend at an angle in relation to each other and to a plane through the main part of the frame. A stop element comprising a cross-member which stiffens the frame and limits the pivoting of each of the flukes in relation to the frame.

5 Claims, 6 Drawing Figures

ANCHOR

This invention relates to anchors of the kind comprising a frame and a pointed bed engagement member pivotable in relation to the frame to both sides between a storage position substantially in the plane of the frame and an anchoring position in which it forms an acute angle to said plane. An anchor of this kind is disclosed in U.S. Pat. No. 2,696,187 (Pitzipio).

One object of the present invention is to provide an anchor which provides more reliable engagement in the sea bed but which, if required, can be released from said engagement more simply than prior-art anchors of the kind mentioned.

To this end, an anchor according to the present invention is characterized substantially in that it comprises at least two pivotable bed engagement members each being pivotable about a pivot extending at an angle in relation to a plane through the main part of the frame.

The anchor may in practice have the form of a cassette which, when required, can be hung on the outside of even a small leisure boat. It is only when the frame has been lowered and occupies a substantially horizontal position in contact with the bed that the pivotable bed engagement members pivot out in different directions from the plane of the frame and provide safe anchorage by engaging in the bed.

Fixing means for an anchor chain or line are preferably adapted to run directly on the frame, which may at least partially consist of rod or tubular material.

The bed engagement members are preferably pivotable in relation to the frame to both sides between the storage position substantially in the plane of the frame and one of two anchorage positions in which each of the bed engagement members forms an acute angle to said plane.

The bed engagement member pivots advantageously form part of the frame which may also be provided with a stop element, for example in the form of a cross-member which limits the pivoting of the bed engagement member in relation to the frame.

In addition to being pivotable, the bed engagement members can also be movable in some other way in relation to the frame, for example displaceable. In an advantageous arrangement the bed engagement members are locked against pivoting in relation to the frame when the latter is in the vertical position of storage or transport. However, when the frame occupies an inclined or horizontal position the bed engagement members are released so that they can assume their swung-out operative positions.

Further features and advantages of an anchor according to the invention will be apparent from the following description of some embodiments thereof with reference to the accompanying drawings wherein.

Figure 4:
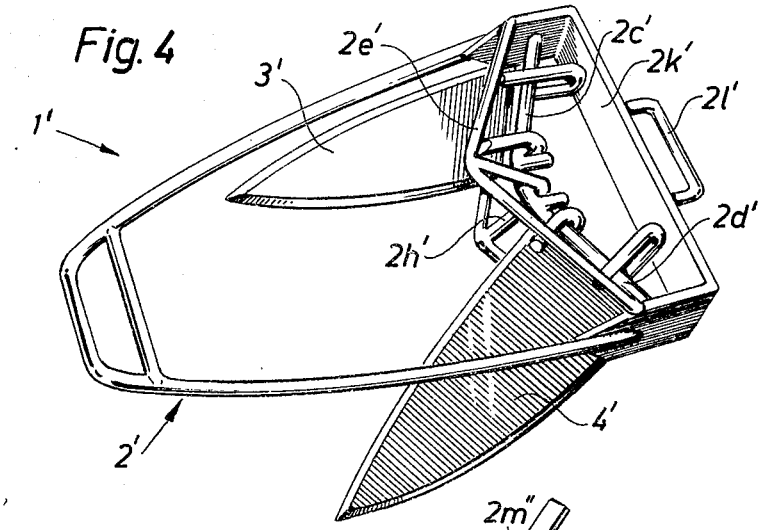
FIG. 4 is a perspective view of a modified embodiment.
Figure 5:
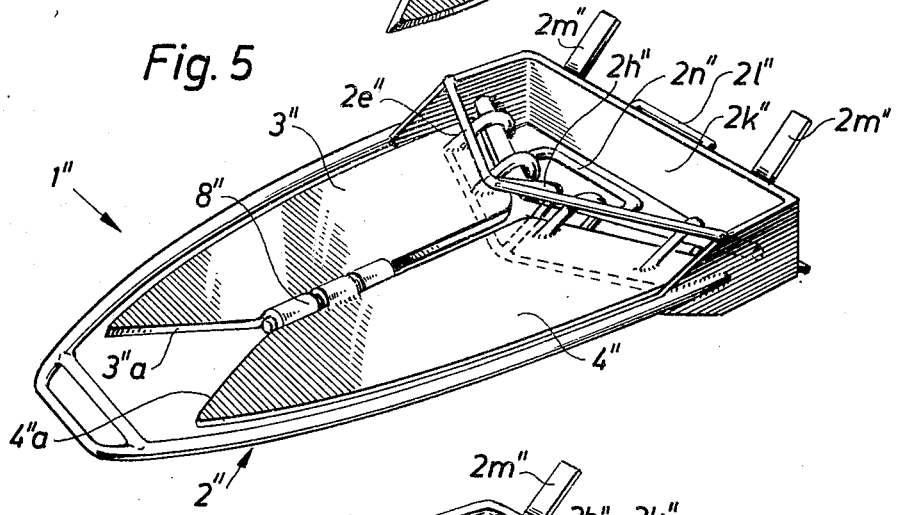
FIG. 5 is a perspective view of a further modification in which the bed engagement members are connected by hinges.
Figure 6:
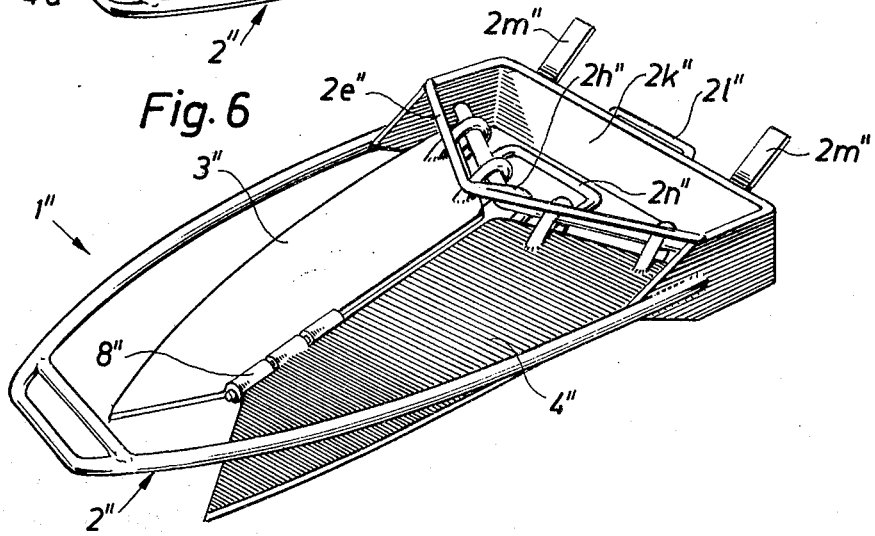
FIG. 6 shows the embodiment according to FIG. 5 with the engagement members in pivoted position.

Corresponding members have been given the same reference numeral in the different Figures but have been provided with one prime sign in FIG. 4 and two such signs in FIGS. 5 and 6.

Figure 1:
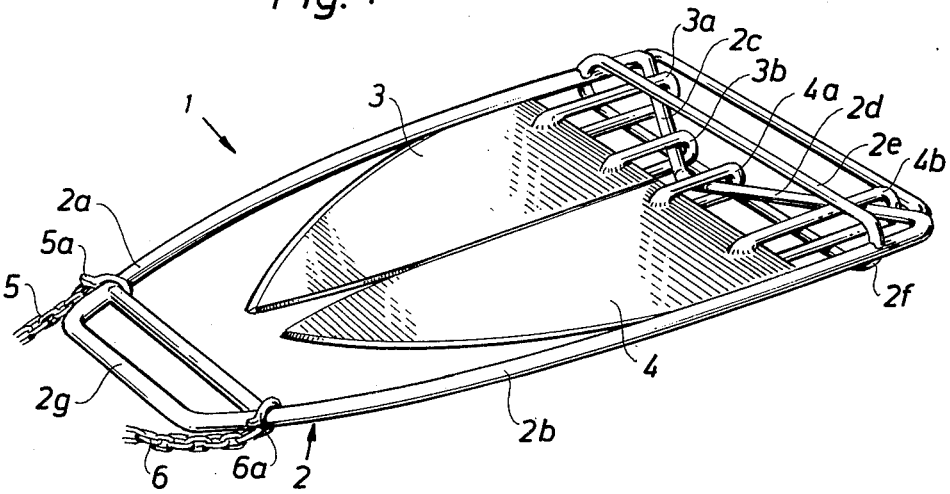
FIG. 1 is a perspective view of an anchor according to the invention with the two bed engagement elements in the swung-in position.
Figure 2:
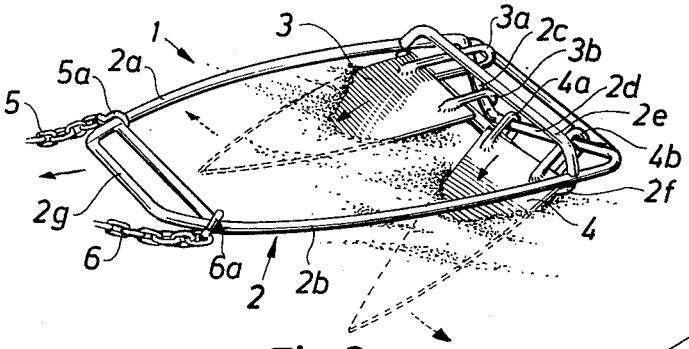
FIG. 2 is a perspective view showing the anchor in the operative position on the sea bed.
Figure 3:
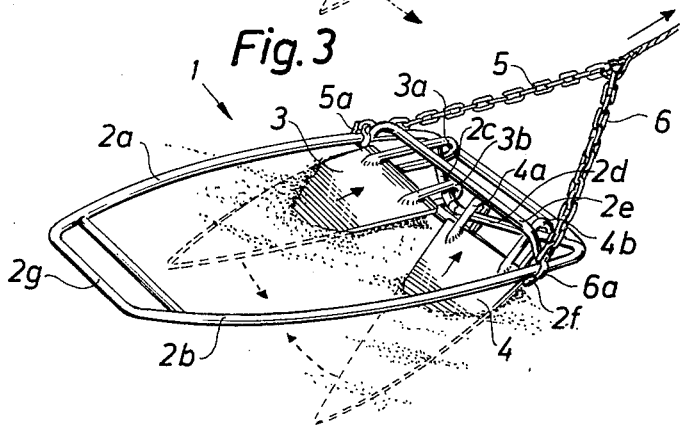
FIG. 3 is a perspective view showing the anchor and anchor chain in the position for releasing the same from the sea bed.

Referring to FIGS. 1–3 an anchor 1 consists of a frame 2 of tubular or rod material. The main part of the frame is in the form of a yoke with two limbs 2*a*, 2*b* and a front connecting member 2*g*. At the rear end of the anchor the limbs merge into two inclined members 2*c*, 2*d* which act as pivots for each bed engagement member or fluke 3, 4.

The members 3, 4 are pivotally mounted by shackles 3*a*, 3*b*; 4*a*, 4*b* on frame members 2*c*, 2*d*, so that they are also displaceable in relation to the frame. The arrangement may be such that the bed engagement members are retained in the plane of the frame when the anchor is in the vertical position of storage while the bed engagement members actuated by gravity pivot out of the plane of the frame (not shown) when the frame occupies an inclined or horizontal position. The pivoting out of the bed engagement members is limited by two stop elements in the form of cross-members 2*e*, 2*f* which also serve to reinforce the frame.

The anchor has an anchor chain or line which, in the embodiment illustrated, comprises two chain portions 5 and 6 movably secured to the frame by fixing elements in the form of wire clasps 5*a*, 6*a* which also act as running eyelets. The two anchor chains are so movable from an anchoring position shown in FIG. 2 into a position shown in FIG. 3 in which pulling of the bed engagement members away from the sea bed is facilitated. The cross-members 2*e*, 2*f* also act as stop elements for the anchor chain movements in these conditions.

In the embodiment shown in FIG. 4 the stop elements 2*e*′, 2*f*′ are bent so that they extend in parallel with the pivots 2*c*′, 2*d*′. They are also connected by means of a central bent rod 2*h*′. The rear part of the frame is constituted by plane wall members 2*k*′ having certain width. Accordingly, the rear part of the anchor frame can be said to form a part of a box or cassette which will protect the bed engagement members 3′, 4′ in the storing position and engage the bed in the operative position of the anchors. Thus, it will contribute to a more reliable engagement in the sea bed. On the middle wall member 2*k*′ there is a centrally positioned handle 21′.

The embodiment illustrated in FIGS. 5 and 6 differs from the one shown in FIG. 4 primarily by comprising a hinge 8″ which pivotably connects the bed engagement members 3″ and 4″ so that they in operative position (FIG. 6) substantially like a plough will dig into the bed. The towards each other directed edges 3″*a* and 4″*a* of the outer portions of the bed engagement members 3″, 4″ are sharpened and will operate like knives.

On the central rear wall member 2*k*″ there is a handle 21″ and two projecting supports or feet 2*m*″. A bent rod 2*n*″ delimits movement of the members 3″, 4″ axially of the pivots and stiffens the frame.

The invention can be modified in various other ways within the scope of its principle. For example, the frame may instead consist of plane or profiled elements of suitable width provided with a separate part or a separate element on which the anchor chain can run. The pivotable bed engagement members may also be pivotally connected to the frame in any arbitrary manner, and the frame may have special locking elements to retain the bed engagement elements in the plane of the frame when the anchor is not in use.

What is claimed is:

1. An anchor, comprising:

a. a frame having a substantially planar configuration, b. a pair of pivot members secured to the frame, said pivot members forming an angle with each other and each of said pivot members extending at an angle in relation to a median plane through the main part of the frame, c. a pair of pointed bed engagement members individually pivotable about the pivot members between a storage position substantially in the plane of the frame and an anchoring position in which they form an acute angle to said plane, and d. a hinge connecting the adjacent edges of said bed engagement members.

2. An anchor as claimed in claim 1, wherein a stop element limits the pivoting of each bed engagement member in relation to the frame, said stop element comprising a cross-member which stiffens the frame.

3. An anchor as claimed in claim 1, wherein a rear portion of the frame consists of at least one substantially planar element.

4. An anchor as claimed in claim 3, wherein the rear planar element of the frame has a handle and a projecting support secured thereto.

5. An anchor as claimed in claim 1, further comprising fixing means for an anchor chain or line, said fixing means being movable relative to the frame between a front anchoring position and a rear position for pulling the anchor free of the bed.

* * * * *